US012714241B2

(12) United States Patent
Kauffmann et al.

(10) Patent No.: US 12,714,241 B2
(45) Date of Patent: Aug. 25, 2026

(54) DIAPER CHANGING SHIELD

(71) Applicants: Kateryna Kauffmann, Winnipeg (CA); Olena Gray, Grande Pointe (CA)

(72) Inventors: Kateryna Kauffmann, Winnipeg (CA); Olena Gray, Grande Pointe (CA)

( * ) Notice: Subject to any disclaimer, the term of this patent is extended or adjusted under 35 U.S.C. 154(b) by 10 days.

(21) Appl. No.: 18/853,372

(22) PCT Filed: Apr. 11, 2023

(86) PCT No.: PCT/CA2023/050489
§ 371 (c)(1),
(2) Date: Oct. 1, 2024

(87) PCT Pub. No.: WO2023/197068
PCT Pub. Date: Oct. 19, 2023

(65) Prior Publication Data

US 2025/0213053 A1 Jul. 3, 2025

(30) Foreign Application Priority Data

Apr. 12, 2022 (CA) ..... 3155126

(51) Int. Cl.
*A47D 15/00* (2006.01)
*A47C 21/00* (2006.01)
*A47D 5/00* (2006.01)

(52) U.S. Cl.
CPC ..... *A47D 15/00* (2013.01); *A47D 5/00* (2013.01); *A47C 21/00* (2013.01)

(58) Field of Classification Search
CPC . A47D 15/00; A47D 5/00; A61G 7/05; A61G 7/0501; A47C 21/00; A47C 21/02; A47C 21/022; A47C 21/024; A47C 21/08
USPC ..... 5/655, 652, 658, 659, 503.1–506.1, 5/424–426
See application file for complete search history.

(56) References Cited

U.S. PATENT DOCUMENTS 4,833,743 A * 5/1989 Howell ..... A61G 7/051 5/426
5,044,025 A * 9/1991 Hunsinger ..... A61G 7/052 5/663
5,097,550 A * 3/1992 Marra, Jr. ..... A61G 7/0524 5/663
5,175,897 A * 1/1993 Marra, Jr. ..... A61G 7/0524 5/663
5,191,663 A * 3/1993 Holder ..... A61G 7/0524 5/663

(Continued)

FOREIGN PATENT DOCUMENTS

GB 2225716 A 6/1990
WO WO-2023197068 A1 * 10/2023 ..... A47D 5/00

*Primary Examiner* — Robert G Santos
(74) *Attorney, Agent, or Firm* — Gurr & Brande, PLLC; Robert A. Gurr

(57) ABSTRACT

A shield assembly includes at least one arm, a shield frame, and a shield cover. In some embodiments, the at least one arm includes a pair of arms configured for insertion between a diaper changing pad and another surface, such as a diaper changing table. The shield frame is attached to the pair of arms and extends perpendicular thereto. The shield cover attaches over the shield frame and shields other items in a room such as carpets, walls, blinds, and clothing, from waste such as urine or liquid feces, which may be excreted by an infant during a diaper change on the diaper changing pad.

12 Claims, 7 Drawing Sheets

(56) References Cited

U.S. PATENT DOCUMENTS

| | | | | |
|---|---|---|---|---|
| 5,671,490 | A * | 9/1997 | Wu | A61G 7/0507 5/426 |
| 6,990,697 | B1 * | 1/2006 | Clute | A61G 7/0518 5/426 |
| 8,338,658 | B1 | 12/2012 | Kruger | |
| 10,912,397 | B2 * | 2/2021 | Levine | A47D 5/00 |
| 2006/0037140 | A1 * | 2/2006 | Clute | A61G 7/0518 5/426 |
| 2009/0172880 | A1 | 7/2009 | Wu | |
| 2011/0179569 | A1 * | 7/2011 | Hayano | A47D 15/008 5/426 |
| 2018/0078052 | A1 | 3/2018 | Levine | |
| 2018/0368587 | A1 | 12/2018 | Trieu et al. | |
| 2021/0378419 | A1 | 12/2021 | Maye | |
| 2025/0213053 | A1 * | 7/2025 | Kauffmann | A47D 15/00 |

* cited by examiner

DIAPER CHANGING SHIELD

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of diaper changing apparatus of existing art and more specifically relates to a shield for use with diaper changing pads.

RELATED ART

An important part of taking care of an infant is the changing of diapers. The process of changing a diaper typically consists of using a diaper changing pad placed atop a diaper changing table, lying the infant down on the diaper changing pad, removing the soiled diaper and securing a fresh diaper to the infant. However, during the period between removal of the soiled diaper and application of the fresh diaper, a problem known all too well by parents and caregivers, is that the infant will often urinate and/or defecate before the fresh diaper is applied. This is of particular concern during certain phases of the infant's growth where diarrhea is common and is usually "explosively" evacuated.

This results in an excessive amount of time spent cleaning surrounding areas with disinfecting wipes, carpet cleaner and deodorizer. Additionally, one must also pre-treat and launder changing pads, bedding, and other fabrics with the same involved techniques used when washing the infant's clothing. This can be quite the headache and energy expenditure, especially during the night as it is cutting into the parent/caregiver's already disrupted sleep schedule. Thus, a suitable solution is desired.

SUMMARY OF THE INVENTION

In view of the foregoing disadvantages inherent in the known diaper changing apparatus art, the present disclosure provides a novel diaper changing shield. The general purpose of the present disclosure, which will be described subsequently in greater detail, is to provide an apparatus for use with a diaper changing pad which is placed at a bottom end of the diaper changing pad to shield waste excreted by an infant during a diaper change on the diaper changing pad.

A shield assembly for use with a diaper changing pad is disclosed herein. The diaper changing pad may rest on a horizontal surface (during the diaper change) and may include a top side opposite a bottom side relative the horizontal surface and a pad top end opposite a pad bottom end relative to a position of the infant on the diaper changing pad. The shield assembly may include at least one arm, a shield frame, and a shield cover. The at least one arm may extend substantially parallel to the horizontal surface. The at least one arm may include a rear end opposite a front end relative to the diaper changing pad and a length therebetween. The at least one arm may be configured for insertion between the bottom side of the diaper changing pad and the horizontal surface at the bottom end of the diaper changing pad.

The shield frame may extend substantially vertically from the rear end of the at least one arm and may be substantially perpendicular thereto. The shield frame may include a left side opposite a right side and a frame top end opposite a frame bottom end relative to the diaper changing pad. The shield cover may be configured to attach to the shield frame and cover at least an area defined by the left side, the right side, the frame top end and the frame bottom end of the shield frame, thereby blocking waste excreted by the infant.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, diaper changing shield, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to diaper changing apparatus and more particularly to a diaper changing shield. Generally, the diaper changing shield may be placed at a (bottom) end of any changing surface underneath a changing pad and may act as an upright shield during diaper changes. In some embodiments, the upright shield may include the ability to fold and unfold. The diaper changing shield may be approximately 14-15 inches wide and 16 inches in height.

A fitted sheet may be provided and configured to slide over the upright shield. The fitted sheet may be waterproof on the inside and cloth on the outside to absorb waste and prevent the waste from leaking downward. As such, the fitted sheet may shield other items in the room, such as carpets, walls, blinds, and clothing, from waste such as urine or liquid feces, that may be excreted by the infant during the diaper change (particularly forcefully evacuated liquid feces as in 'explosive diarrhea'). The fitted sheet may then be removed and machine washed when soiled.

Figure 1:
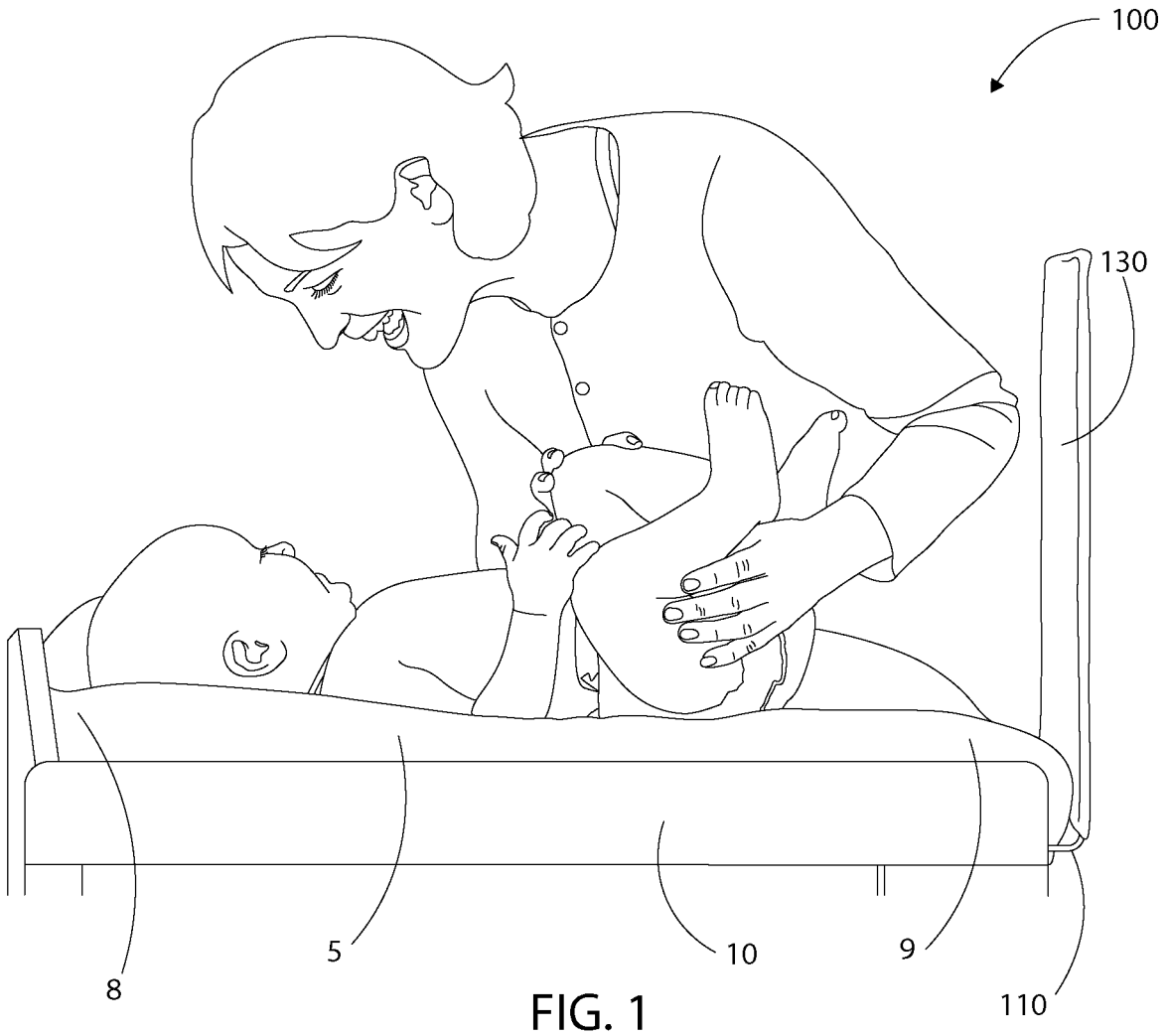
FIG. 1 is a perspective view of a shield assembly being used during a diaper change of an infant, according to an embodiment of the disclosure.
Figure 2:
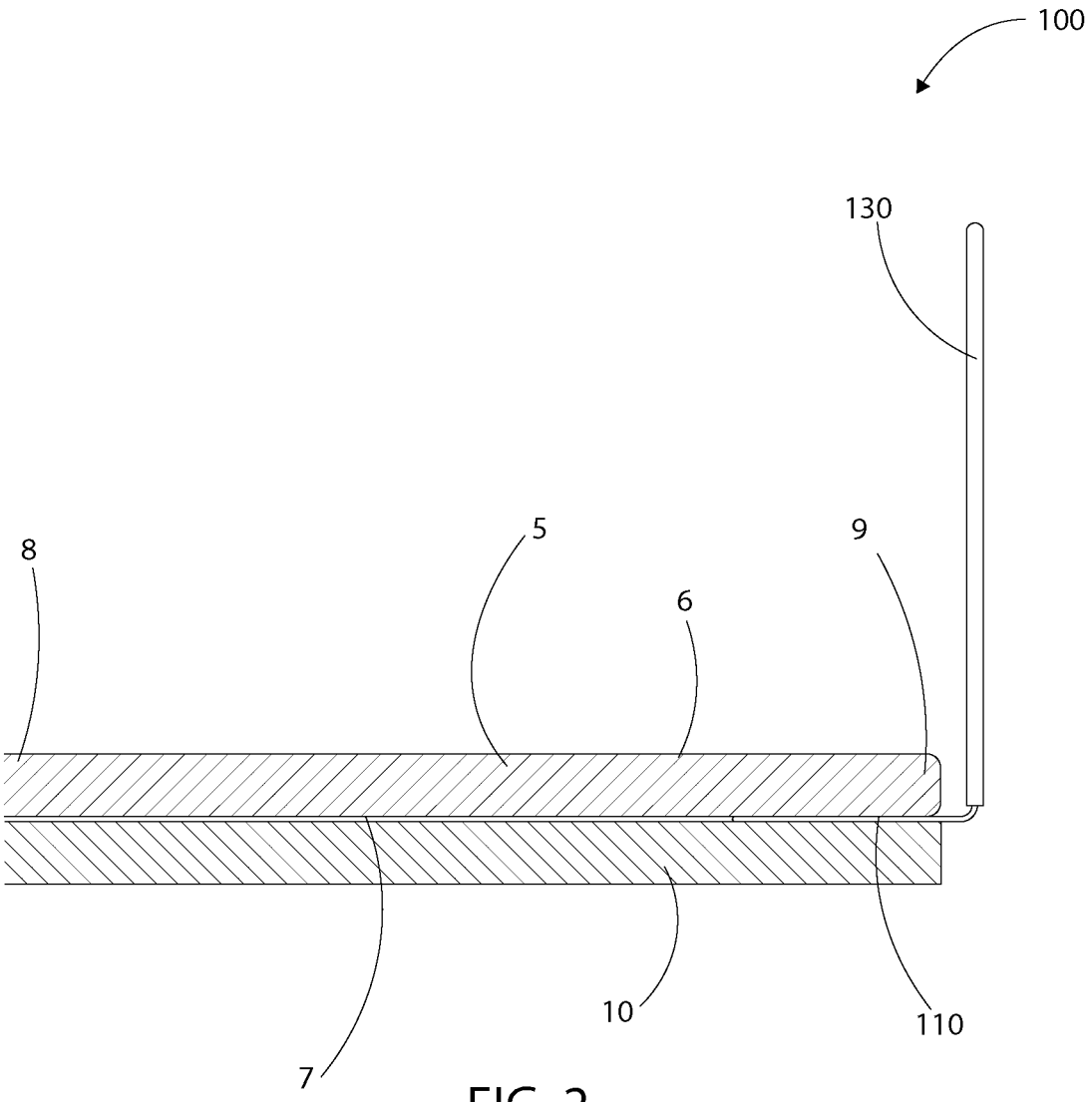
FIG. 2 is a cross-sectional view of the shield assembly of FIG. 1 and illustrating the at least one arm and a shield cover, the at least one arm being inserted between a horizontal surface and a diaper changing pad, according to an embodiment of the present disclosure.
Figure 3:
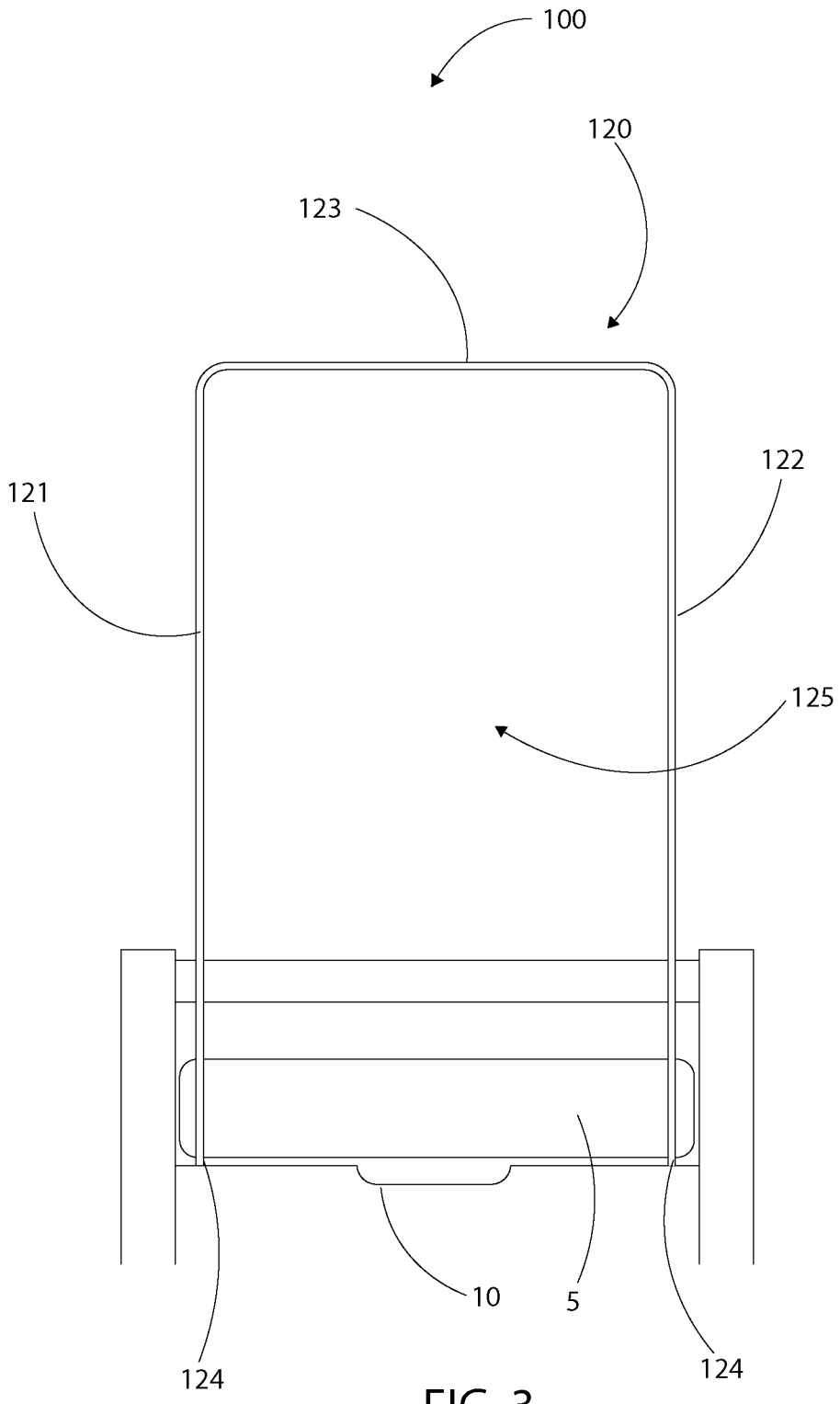
FIG. 3 is a rear view of the shield assembly illustrating a shield frame thereof and the at least one arm inserted between the horizontal surface and the diaper changing pad, according to an embodiment of the present disclosure.

Referring now more specifically to the drawings by numerals of reference, there is shown in FIGS. 1-7, various views of a shield assembly 100. As shown, the shield assembly 100 may include at least one arm 110, a shield frame 120 and a shield cover 130. As shown in FIGS. 1-3, the shield assembly 100 may be used with a diaper changing pad 5. The diaper changing pad 5 may rest on a horizontal surface 10 and may include a top side 6 opposite a bottom side 7 relative the horizontal surface 10 (the bottom side 7 being the side in which contacts the horizontal surface 10 and the pad top side 6 being the side in which an infant is placed for a diaper change).

In some examples, as shown in FIG. 1 particularly, the horizontal surface 10 may include a changing table. In other embodiments, the horizontal surface 10 may be a floor, a bed, a table, etc. The diaper changing pad 5 may further include a pad top end 8 opposite a pad bottom end 9 relative to a position of the infant on the diaper changing pad 5 (the pad bottom end 9 being near legs of the infant and the pad top end 8 being near a head of the infant).

Figure 4:
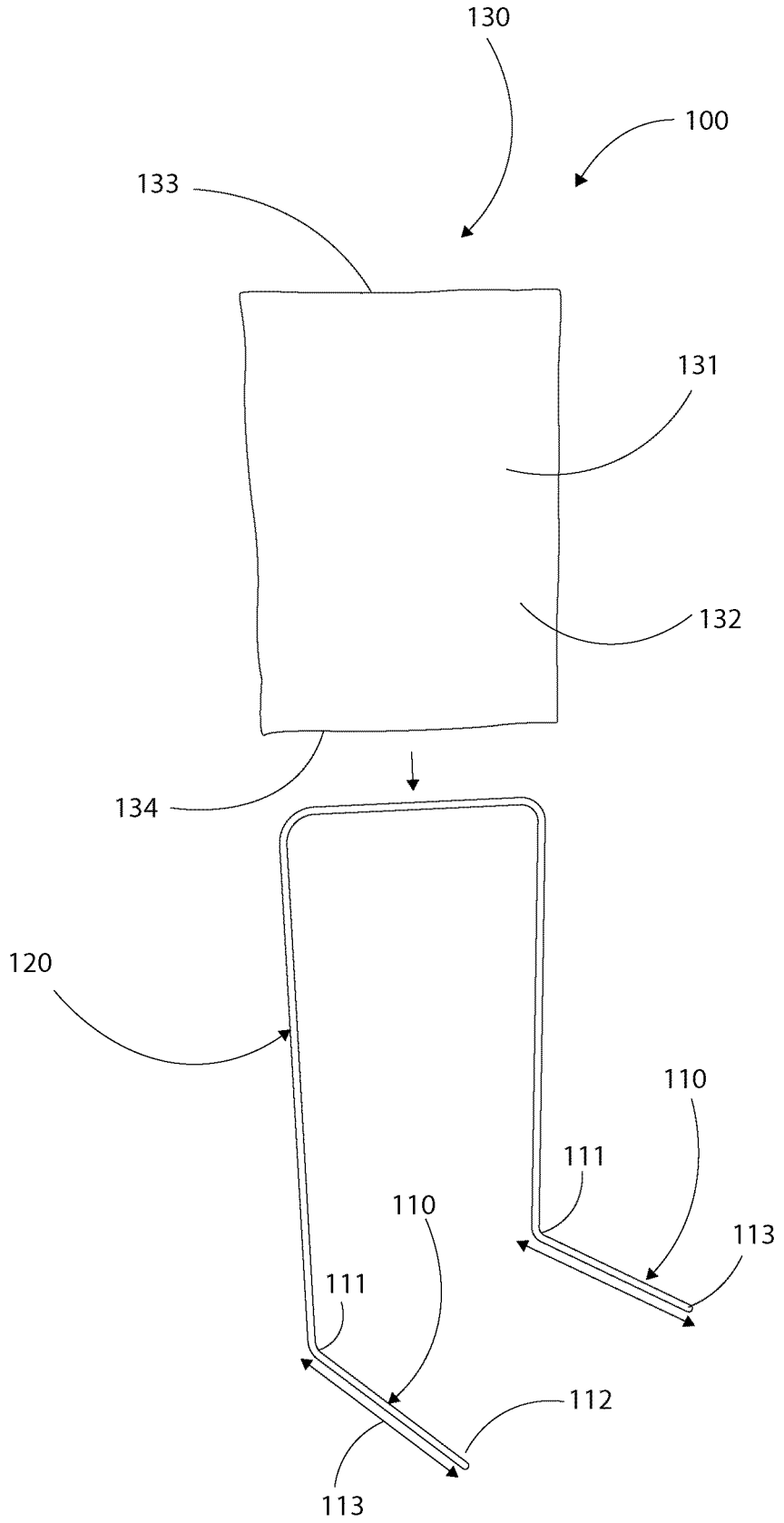
FIG. 4 is a front perspective view of the shield assembly illustrating a pair of arms, the frame shield and the frame cover, according to an embodiment of the present disclosure.
Figure 5:
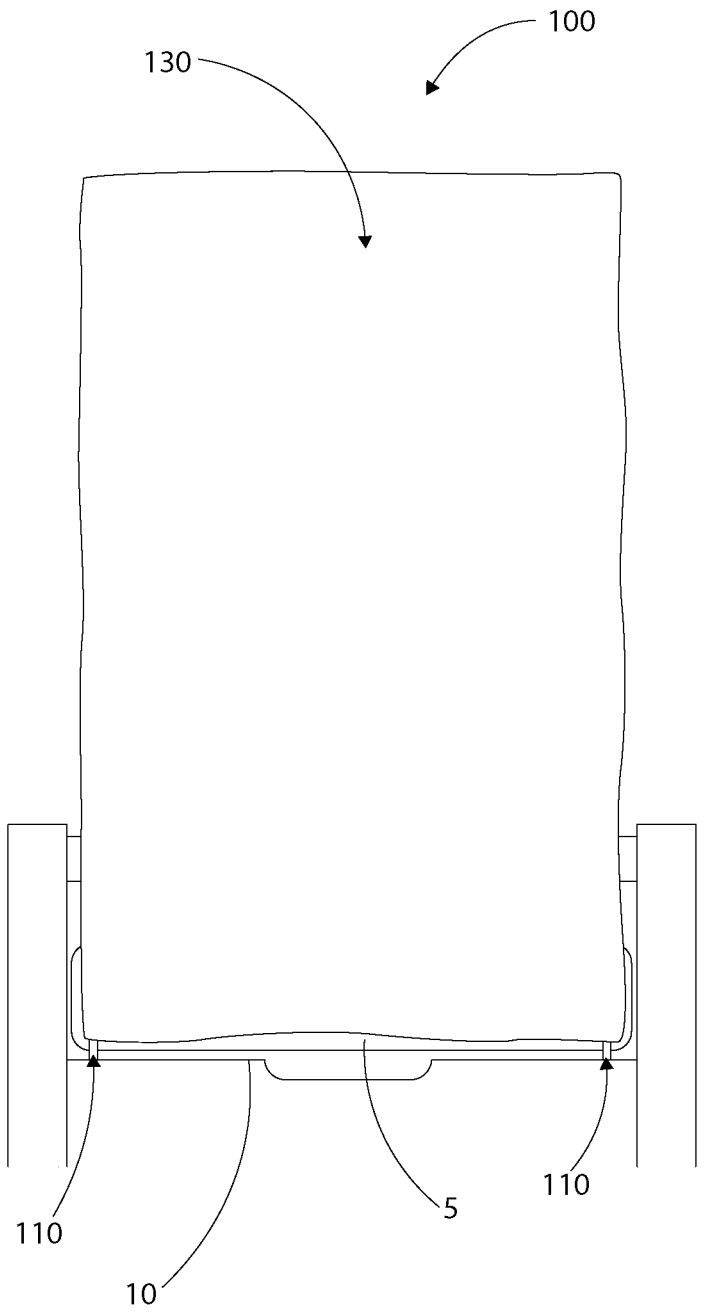
FIG. 5 is a rear view of the shield assembly of FIG. 3 illustrating the shield cover encompassing the shield frame, according to an embodiment of the present disclosure.
Figure 6:
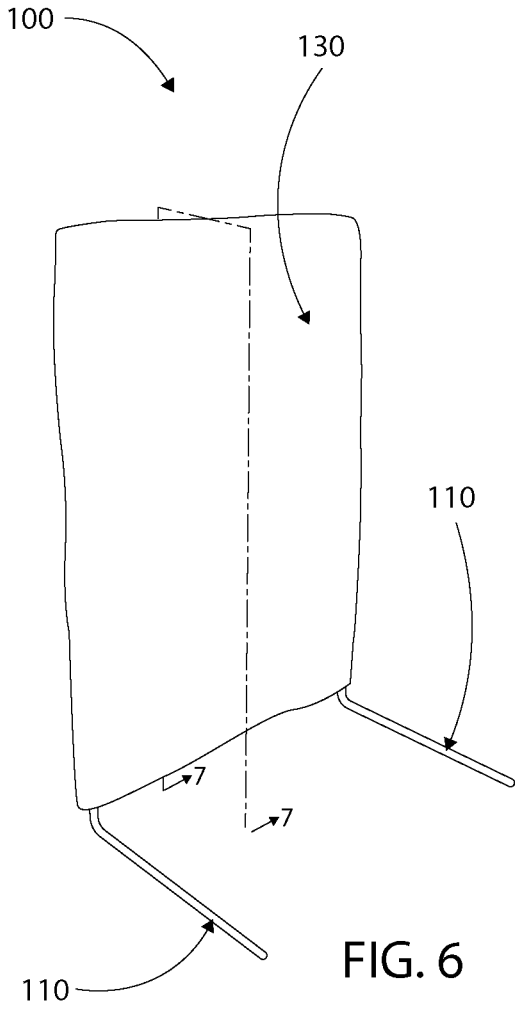
FIG. 6 is a front perspective view of the shield assembly of FIG. 4 illustrating the shield cover encompassing the shield frame, according to an embodiment of the present disclosure.

As shown in FIG. 2 particularly, the at least one arm 110 may be configured for insertion between the bottom side 7 of the diaper changing pad 5 and the horizontal surface 10 at the pad bottom end 9 of the diaper changing pad 5 and may extend substantially parallel to the horizontal surface 10. Particularly, the at least one arm 110 may be 'sandwiched' between the diaper changing pad 5 and the horizontal surface 10. As shown in FIG. 4, the at least one arm 110 may include a rear end 111 opposite a front end 112 relative to the diaper changing pad 5 and a length 113 therebetween. In some embodiments, the shield assembly 100 may be removed from the diaper changing pad 5 after each use. In other embodiments, the shield assembly 100 may be a semi-permanent addition to the diaper changing pad 5.

In some embodiments, the at least one arm 110 may include a pair of arms 110 spaced opposite and parallel to each other. Each of the pair of arms 110 may include the rear end 111 opposite the front end 112 relative to the diaper changing pad 5 and the length 113 therebetween. The length 113 of each of the pair of arms 110 may be sufficient enough to properly support the weight of the shield assembly 100 and prevent tipping thereof. For example, in some embodiments and as demonstrated in FIG. 4, the length 113 of each of the pair of arms 110 may be between 5-10 inches, as measured from the rear end 111 to the front end 112 of each of the pair of arms 110.

Figure 7:
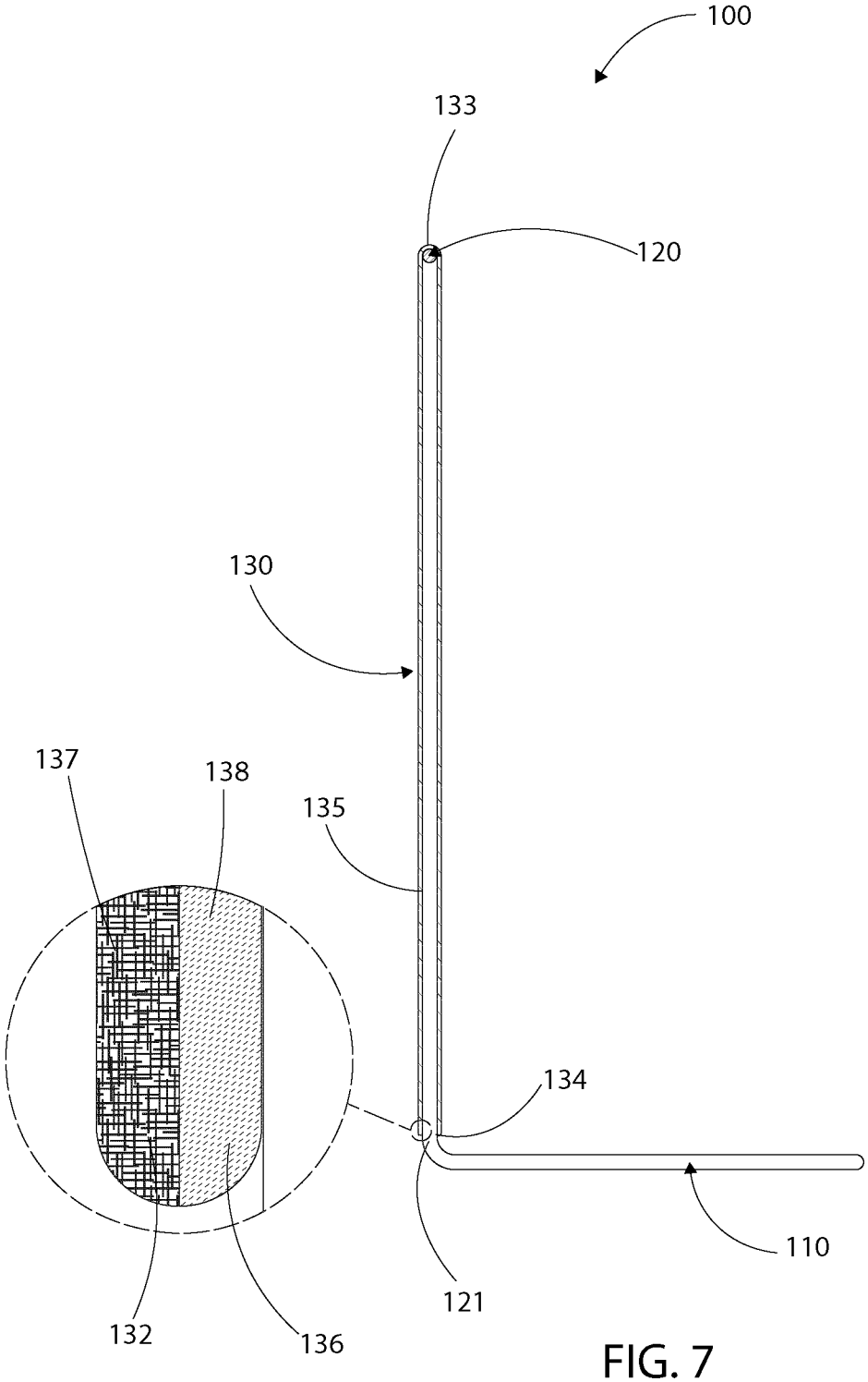
FIG. 7 is a cross-sectional view of the shield assembly taken from line 7-7 in FIG. 6 illustrating the shield cover including an outer surface being made from a first material and an inner surface being made from a second material, according to an embodiment of the present disclosure.

As shown in these figures, the shield frame 120 may extend substantially vertically from the rear end 111 of the at least one arm 110 and may be oriented substantially perpendicular thereto. The shield frame 120 may include a left side 121 opposite a right side 122 and a frame top end 123 opposite a frame bottom end 124 relative to the diaper changing pad 5. In some embodiments, as shown in FIG. 4 and FIG. 7 particularly, the shield frame 120 may be permanently attached to the pair of arms 110. For example, the left side 121 of the shield frame 120 may be attached to one of the pair of arms 110, and the right side 122 of the shield frame 120 may be attached to another one of the pair of arms 110.

As shown in FIG. 3, in some embodiments, the frame top end 123 may include a horizontal bar, the left side 121 and the right side 122 may include two vertical bars and the frame bottom end 124 may be the point at which the left side 121 and the right side 122 attach to the pair of arms 110. In some embodiments, the left side 121 and the right side 122 may be pivotably attached to the pair of arms 110, respectively, thereby enabling the shield frame 120 to fold, moving the shield frame 120 from the perpendicular position relative to the pair of arms 110 to a (at least substantially) parallel position relative to the pair of arms 110. Further, in some embodiments, the shield frame 120 may include a height of 16 inches, as measured from the frame top end 123 to the frame bottom end 124; and a width of between 14-15 inches from the left side 121 to the right side 122.

The shield cover 130 may be configured to attach to the shield frame 120 and cover at least an area between the left side 121, the right side 122, the frame top end 123 and the frame bottom end 124 of the shield frame 120, thereby blocking waste excreted by the infant in the area. For example, preferably, the shield cover 130 may be configured to fully cover the shield frame 120.

In some embodiments, the shield cover 130 may be a flexible cover. Particularly, as shown in FIG. 4, the shield cover 130 may include an outer shell 131 having an outer surface 132, a closed end 133 opposite a substantially open end 134, and an interior 135 having an inner surface 136 (FIG. 7). As demonstrated in FIGS. 3-6, the open end 134 may be configured to slide over the frame top end 123 of the shield frame 120 and encompass the shield frame 120. Preferably, the shield cover 130 may be fitted to the shield frame 120. As such, the shield cover 130 may include a height and width substantially equal to the shield frame 120.

In other embodiments, the shield cover 130 may include a greater height than the shield frame 120. For example, the open end 134 of the shield cover 130 may be configured to extend over and cover the pad bottom end 9 of the diaper changing pad 5. This may enable the shield cover 130 to contain any waste thereon, and also enable the shield cover 130 to be folded prior to removal of the shield cover 130 from the shield frame 120, thereby preventing the waste from dripping onto the pad bottom end 9 of the diaper changing pad 5. In some examples, the shield cover 130 may extend between 2-5 inches over the pad bottom end 9 of the diaper changing pad 5.

Preferably, as shown in FIG. 7, the outer surface 132 may be made from a first material 137 and the inner surface 136 may be made from a second material 138. Particularly, the first material 137 may be an absorbent material configured to absorb the waste and at least partially prevent the waste from leaking downward (via gravity). For example, in some embodiments, the absorbent material may be cloth. The shield cover 130 may thus preferably be removable from the shield frame 120, enabling the shield cover 130 to be washed (or in some embodiments disposed of). The second material 138 may preferably be a waterproof material. For example, the waterproof material may include polyester, nylon, etc.

In use, the user may place the diaper changing pad 5 on the horizontal surface 10 (such as a changing table) and insert the at least one arm 110 (in some embodiments, the pair of arms 110) between the diaper changing pad 5 and the horizontal surface 10 at the pad bottom end 9 of the diaper changing pad 5, such that the shield frame 120 stands vertically at the pad bottom end 9 of the diaper changing pad 5. The user may then attach the shield cover 130 to the shield frame 120 to cover at least the area defined by the left side 121, the right side 122, the frame top end 123 and the frame bottom end 124 of the shield frame 120. Particularly, the user may slide the open end 134 of the shield cover 130 over the frame top end 123 of the shield frame 120 until the open end 134 of the shield cover 130 reaches the frame bottom end 124 of the shield frame 120 and the shield cover 130 completely encompasses the shield frame 120. In some embodiments, the user may continue to slide the open end 134 of the shield cover 130 over the pad bottom end 9 of the diaper changing pad 5 also.

The user may then place their infant on the diaper changing pad 5 and change the diaper. During the diaper change, waste may soil the shield cover 130, whilst the shield cover 130 shields and prevents the waste from reaching other objects in the room. After the diaper change, the user may then remove the shield cover 130 from the shield frame 120 and wash or dispose of the shield cover 130. In some embodiments, prior to removal of the shield cover 130, the user may fold the portion of the shield cover 130 that is extended over the pad bottom end 9 of the diaper changing pad 5, thereby containing any waste thereon and preventing the waste from dripping.

It should be noted that certain steps are optional step and may not be implemented in all cases. It should also be noted that the steps described in the method of use can be carried out in many different orders according to user preference. The use of "step of" should not be interpreted as "step for", in the claims herein and is not intended to invoke the provisions of 35 U.S.C. § 112(f) or equivalent. It should also be noted that, under appropriate circumstances, considering such issues as design preference, user preferences, marketing preferences, cost, structural requirements, available materials, technological advances, etc., other methods for using a shield assembly are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A shield assembly for use with a diaper changing pad, the diaper changing pad resting on a horizontal surface and including a top side opposite a bottom side relative the horizontal surface and a pad top end opposite a pad bottom end relative to a position of an infant on the diaper changing pad, the shield assembly comprising:

at least one arm extending substantially parallel to the horizontal surface, the at least one arm including a rear end opposite a front end relative to the diaper changing pad and a length therebetween, the at least one arm configured for insertion between the bottom side of the diaper changing pad and the horizontal surface at the bottom end of the diaper changing pad;

a shield frame extending substantially vertically from the rear end of the at least one arm and being substantially perpendicular thereto, the shield frame including a left side opposite a right side and a frame top end opposite a frame bottom end relative to the diaper changing pad; and a shield cover configured to attach to the shield frame and cover at least an area defined by the left side, the right side, the frame top end and the frame bottom end of the shield frame, thereby blocking waste excreted by the infant;

wherein the shield cover includes an outer shell having an outer surface, a closed end opposite a substantially open end, and an interior having an inner surface, and wherein the open end is configured to slide over the frame top end of the shield frame and encompass the shield frame;

wherein the outer surface is made from a first, absorbent material, and wherein the inner surface is made from a second, waterproof material.

2. The shield assembly of claim 1, wherein the shield cover is fitted to the shield frame and thereby the shield cover includes a height and width substantially equal to the shield frame.

3. The shield assembly of claim 1, wherein the at least one arm includes a pair of arms spaced opposite and parallel each other.

4. The shield assembly of claim 3, wherein the length of each of the pair of arms is between 5-10 inches, as measured from the rear end to the front end of each of the pair of arms.

5. The shield assembly of claim 4, wherein the shield frame includes a height of 16 inches, as measured from the frame top end to the frame bottom end.

6. The shield assembly of claim 5, wherein the shield frame includes a width of between 14-15 inches, as measured from the left side to the right side.

7. A shield assembly for use with a diaper changing pad, the changing pad resting on a horizontal surface and including a top side opposite a bottom side relative the horizontal surface and a pad top end opposite a pad bottom end relative to a position of an infant on the diaper changing pad, the shield assembly comprising:

a pair of arms spaced opposite and parallel each other, each of the pair of arms extending substantially parallel to the horizontal surface and each including a rear end opposite a front end relative to the diaper changing pad and a length therebetween, the pair of arms configured for insertion between the bottom side of the diaper changing pad and the horizontal surface at the bottom end of the diaper changing pad;

a shield frame extending substantially vertically from the rear end of the pair of arms and being substantially perpendicular thereto, the shield frame including a left side opposite a right side and a frame top end opposite a frame bottom end relative to the diaper changing pad; and a shield cover including an outer shell having an outer surface, a closed end opposite a substantially open end, and an interior having an inner surface, the outer surface being made from an absorbent material, the inner surface being made from a waterproof material, the open end configured to slide over the frame top end of the shield frame and encompass the shield frame, thereby blocking waste excreted by the infant, the shield cover being fitted to the shield frame and thereby the shield cover including a height and width substantially equal to the shield frame.

8. The shield assembly of claim 7, wherein the length of each of the pair of arms is between 5-10 inches, as measured from the rear end to the front end of each of the pair of arms.

9. The shield assembly of claim 8, wherein the shield frame includes a height of 16 inches, as measured from the frame top end to the frame bottom end.

10. The shield assembly of claim 9, wherein the shield frame includes a width of between 14-15 inches, as measured from the left side to the right side.

11. A method of using a shield assembly for use with a diaper changing pad to shield surrounding surfaces from waste excreted by an infant during a diaper change, the method comprising:

placing a diaper changing pad on a horizontal surface, the diaper changing pad including a top side for receiving the infant, a bottom side opposite the top side, a pad top end, and a pad bottom end;

inserting at least one arm of the shield assembly between the bottom side of the diaper changing pad and the horizontal surface at the pad bottom end, the at least one arm extending substantially parallel to the horizontal surface;

positioning a shield frame of the shield assembly so that the shield frame extends substantially vertically from a rear end of the at least one arm at the pad bottom end;

sliding an open end of a shield cover over a frame top end of the shield frame such that the shield cover fully encompasses the shield frame, the shield cover comprising:

an outer surface made from an absorbent material configured to absorb waste excreted by the infant; and an inner surface made from a waterproof material configured to prevent the absorbed waste from leaking through the shield cover;

placing the infant on the top side of the diaper changing pad with the shield cover interposed between a caregiver and the infant and performing a diaper change while the shield cover blocks waste excreted by the infant from contacting the caregiver; and after the diaper change, removing the shield cover from the shield frame.

12. The method of claim 11, further including folding a portion of the shield cover adjacent the pad bottom end to contain any waste therein prior to removal.

* * * * *